US010843825B2

(12) United States Patent
Choi

(10) Patent No.: US 10,843,825 B2
(45) Date of Patent: Nov. 24, 2020

(54) SEALING FOIL CUTTING ASSEMBLY AND HIGH-FREQUENCY CAPLESS SEALING APPARATUS HAVING THE SAME

(71) Applicant: SMART CORPORATION CO., LTD., Incheon (KR)

(72) Inventor: Ki Seok Choi, Incheon (KR)

(73) Assignee: Smart Corporation Co., Ltd., Incheon (KR)

( * ) Notice: Subject to any disclaimer, the term of this patent is extended or adjusted under 35 U.S.C. 154(b) by 211 days.

(21) Appl. No.: 16/052,104

(22) Filed: Aug. 1, 2018

(65) Prior Publication Data

US 2019/0193877 A1 Jun. 27, 2019

(30) Foreign Application Priority Data

Dec. 27, 2017 (KR) ..... 10-2017-0181032

(51) Int. Cl.
*B65B 7/01* (2006.01)
*B65B 7/16* (2006.01)
*B67B 5/03* (2006.01)

(52) U.S. Cl.
CPC ..... *B65B 7/01* (2013.01); *B65B 7/162* (2013.01); *B65B 7/164* (2013.01); *B67B 5/03* (2013.01)

(58) Field of Classification Search
CPC ..... B65B 7/01; B65B 7/162; B65B 7/164; B65B 7/00; B65B 51/227; B67B 5/03
USPC ..... 53/290, 296, 297, 298
See application file for complete search history.

(56) References Cited

U.S. PATENT DOCUMENTS 4,155,439 A * 5/1979 Fletcher ..... B21D 51/46 198/339.1
4,230,028 A * 10/1980 Knudsen ..... B21D 51/46 413/47
4,526,562 A * 7/1985 Knudsen ..... B21D 51/46 493/353
4,625,498 A * 12/1986 Parsons ..... B65B 7/164 156/261
6,035,607 A * 3/2000 Miller ..... B65B 7/164 53/266.1

(Continued)

FOREIGN PATENT DOCUMENTS

JP 3604041 B1 12/2004

OTHER PUBLICATIONS

Office Action dated Feb. 12, 2018, issued in Korean Patent Application No. 10-2017-0181032, with English Translation.

*Primary Examiner* — Andrew M Tecco
*Assistant Examiner* — Nicholas E Igbokwe
(74) *Attorney, Agent, or Firm* — Harness, Dickey & Pierce, P.L.C.

(57) ABSTRACT

There is provided a sealing foil cutting assembly including: a cutting die including a slot through which a sealing tape penetrates, and a penetrating hole formed in a direction perpendicular to the slot; and a punch configured to move up along the penetrating hole of the cutting die to cut the sealing tape to form a sealing foil to be used for sealing an entrance of the container, the punch including: a lid cutting portion configured to form a lid region of the sealing foil; a tab cutting portion having an empty space formed therein to form a tab region protruding from a side surface of the lid of the sealing foil; and a finger member disposed in the empty space of the tab cutting portion, and having an upper end bent toward a surface of the lid cutting portion.

5 Claims, 14 Drawing Sheets

(56) References Cited

U.S. PATENT DOCUMENTS

| | | | | |
|---|---|---|---|---|
| 6,174,274 | B1 * | 1/2001 | Hawkins | B21D 51/46<br>493/110 |
| 8,407,972 | B2 * | 4/2013 | Gill | B29C 66/81457<br>53/478 |
| 2004/0112008 | A1 * | 6/2004 | Voss | B29C 65/18<br>53/329.3 |
| 2010/0107569 | A1 * | 5/2010 | Havemann | B29C 66/83221<br>53/479 |

* cited by examiner

SEALING FOIL CUTTING ASSEMBLY AND HIGH-FREQUENCY CAPLESS SEALING APPARATUS HAVING THE SAME

CROSS-REFERENCE TO RELATED PATENT APPLICATION

This application claims priority from Korean Patent Application No. 10-2017-0181032, filed on Dec. 27, 2017 in the Korean Intellectual Property Office, the disclosure of which is incorporated herein by reference in its entirety.

FIELD

The present disclosure relates to a high-frequency capless sealing apparatus for sealing a container, and more particularly, to a high-frequency capless sealing apparatus which automatically produces a sealing foil having a tab for a handle, and seals a container by using the sealing foil.

BACKGROUND

A high-frequency capless sealing apparatus, which seals an entrance of a container filled with contents in an induction sealing method using a sealing foil such as an aluminum foil, etc., is widely used in industrial fields. According to a related-art high-frequency capless sealing apparatus, a sealing foil is formed by being cut out of a sealing tape, and then is placed on an upper portion of a container, and the entrance of the container is sealed by heating the sealing foil by applying a high frequency current to an induction coil.

The container sealed in this way substantially has a shape as illustrated in FIG. 1. A sealing foil 6 may be formed of a lid 6*a* and a tab 6*b*. The lid 6*a* covers and seals an entrance 2 of a container 1, and the tab 6*b* serves as a handle to allow a user to easily remove the sealing foil 6. However, in the case of the container 1 sealed by the related-art sealing apparatus, the tab 6*b* may be in close contact with the entrance 2 of the container as shown in FIG. 1, and thus, it may be hard for the user to hold the tab 6*b* with user's hand. To solve this problem, the tab 6*b* may be made long to be easy to handle with a hand, but this is not an appropriate measure since a sealing defect frequently occurs in the tab 6*b*.

In addition, the related-art sealing apparatus has another problem in a transfer path when transferring the sealing foil to the upper portion of the container after cutting the sealing foil out of the sealing tape. That is, the sealing foil should be transferred with a large rotation radius or by a long transfer distance when the sealing foil is transferred from a sealing foil forming unit to a container sealing unit. Therefore, there is a limit to making the size of the sealing apparatus compact, and the sealing foil may deviate from a transferring means due to a centrifugal force or inertia, and thus reliability of the sealing apparatus may deteriorate.

In addition, the related-art sealing apparatus has still another problem that it is not easy to check a sealing state after the container is sealed. A related-art examination device examines a sealed portion by using visible rays or a thermal image, but the accuracy of examination is not high and long time is required to examine. Therefore, all containers are not examined and are examined randomly.

SUMMARY

The present disclosure has been developed to solve the above-described problems, and an object of the present disclosure is to provide an apparatus for producing a sealing foil which is easily removed by a user, and for sealing a container.

The present disclosure provides a sealing apparatus configured to transfer a sealing foil by a short distance from a sealing forming unit to a container sealing unit, and to have a simple structure and to complete a container sealing operation within a short time.

Also, the present disclosure provides a sealing apparatus including a sealing examination unit configured to determine whether sealing of a container is normal or poor, rapidly, with respect to all containers.

According to an embodiment of the present disclosure, there is provided a sealing foil cutting assembly used in a capless sealing apparatus for sealing a container, the sealing foil cutting assembly including: a cutting die including a slot through which a sealing tape penetrates, and a penetrating hole formed in a direction perpendicular to the slot; and a punch configured to move up along the penetrating hole of the cutting die to cut the sealing tape to form a sealing foil to be used for sealing an entrance of the container, the punch including: a lid cutting portion configured to form a lid region of the sealing foil; a tab cutting portion having an empty space formed therein to form a tab region protruding from a side surface of the lid of the sealing foil; and a finger member disposed in the empty space of the tab cutting portion, and having an upper end bent toward a surface of the lid cutting portion.

According to an embodiment of the present disclosure, there is provided a method for forming a sealing foil by using the above-described sealing foil cutting assembly, the method including the steps of: forming, by the punch moving up through the penetrating hole of the cutting die, a sealing foil having a lid region and a tab region; and bending the tab region of the sealing foil to overlap with the lid region by moving the bent upper end from the first position to the second position by applying a force to the finger member.

According to an embodiment of the present disclosure, there is provided a capless sealing apparatus for sealing a container, the apparatus including: a sealing tape transfer unit including a supply roll having a sealing tape wound therearound, and a collection roll to collect the sealing tape; a sealing foil cutting assembly disposed on a transfer path of the sealing tape between the supply roll and the collection roll, and having the above-described configuration; a container support stand disposed adjacent to the sealing foil cutting assembly, and configured to support the container to be sealed; and a container sealing unit configured to adsorb the sealing foil placed on a surface of the punch and to transfer the sealing foil to an upper portion of the entrance of the container supported on the container support stand, and to adsorb the sealing foil onto the entrance of the container.

According to an embodiment of the present disclosure, since the container is sealed with the tab region of the sealing foil overlapping with an upper portion of the lid region, a user can easily remove the sealing foil.

According to another embodiment of the present disclosure, since the sealing foil is transferred by a short distance from the sealing forming unit to the container sealing unit, a container sealing operation can be completed within a short time, and the sealing apparatus can have a simplified structure.

According to still another embodiment of the present disclosure, since the sealing apparatus includes a sealing examination unit configured to determine whether sealing of the container is normal or poor, the sealing apparatus can rapidly determine whether the sealing of the container is normal or poor with respect to all containers.

BRIEF DESCRIPTION OF THE DRAWINGS

The above and other features and advantages will become more apparent by describing in detail exemplary embodiments with reference to the attached drawings in which.

DETAILED DESCRIPTION

Figure 1:
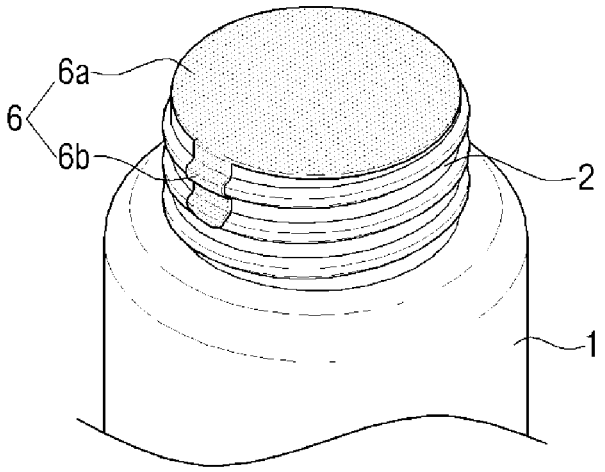
FIG. 1 is a view to illustrate a related-art container sealing foil.

Exemplary embodiments will now be described more fully with reference to the accompanying drawings to clarify aspects, other aspects, features and advantages of the present disclosure. The exemplary embodiments may, however, be embodied in many different forms and should not be construed as limited to the exemplary embodiments set forth herein. Rather, the exemplary embodiments are provided so that this disclosure will be thorough and complete, and will fully convey the scope of the application to those of ordinary skill in the art.

It will be understood that when an element is referred to as being "on" another element, the element can be directly on another element or intervening elements. In the drawings, thickness of elements are exaggerated for effective explanation of the technical features.

If the terms such as 'first' and 'second' are used to describe elements, these elements should not be limited by such terms. These terms are used for the purpose of distinguishing one element from another element only. The exemplary embodiments include their complementary embodiments.

As used herein, the singular forms "a", "an" and "the" are intended to include the plural forms as well, unless the context clearly indicates otherwise. It will be further understood that the terms "comprises" and/or "comprising," when used in this specification, do not preclude the presence or addition of one or more other components.

Hereinafter, exemplary embodiments will be described in greater detail with reference to the accompanying drawings. The matters defined in the description, such as detailed construction and elements, are provided to assist in a comprehensive understanding of the exemplary embodiments. However, it is apparent that the exemplary embodiments can be carried out by those of ordinary skill in the art without those specifically defined matters. In the description of the exemplary embodiment, certain detailed explanations of related art are omitted when it is deemed that they may unnecessarily obscure the essence of the inventive concept.

Figure 2:
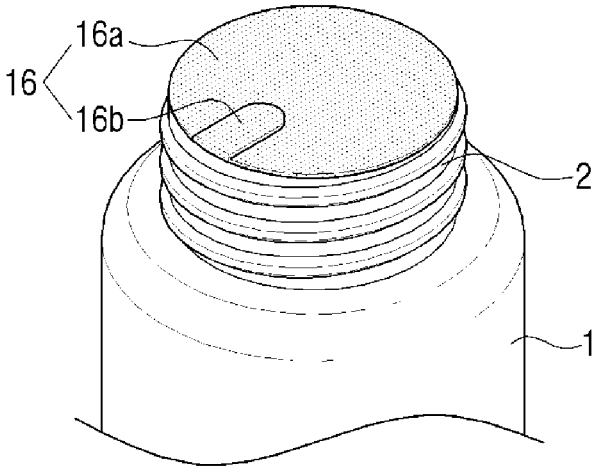
FIG. 2 is a view illustrating a sealing foil according to an embodiment of the present disclosure.

FIG. 2 is a view illustrating a container sealed by a sealing foil produced according to an embodiment of the present disclosure. As shown in FIG. 2, the sealing foil 16 according to an embodiment of the present disclosure includes a lid 16*a* region for covering and sealing an entrance 2 of a container 1, and a tab 16*b* region serving as a handle for a user to easily open the container 1. A cap (lid) (not shown) of the container 1 closes the container 1 with the tab 16*b* being folded upward and overlapping with an upper portion of the lid 16*a*. According to the configuration of the sealing foil 16 described above, the user can easily hold the tab 16*b* with user's hand, and thus there is an advantage that the container 1 is easily opened compared to related-art technology.

Hereinafter, a sealing foil cutting assembly for automatically producing the sealing foil 16 to seal a container, and a capless sealing apparatus including the cutting assembly according to an embodiment of the present disclosure will be described.

The sealing foil 16, which is a member for sealing the entrance of the container, may be referred to as a "seal liner," a "cap liner," "seal paper, a "seal film," an "induction liner," or the like in the relevant field. In the present disclosure, the "sealing foil" will be used as long as there is no benefit to distinguish these terms.

Figure 3:
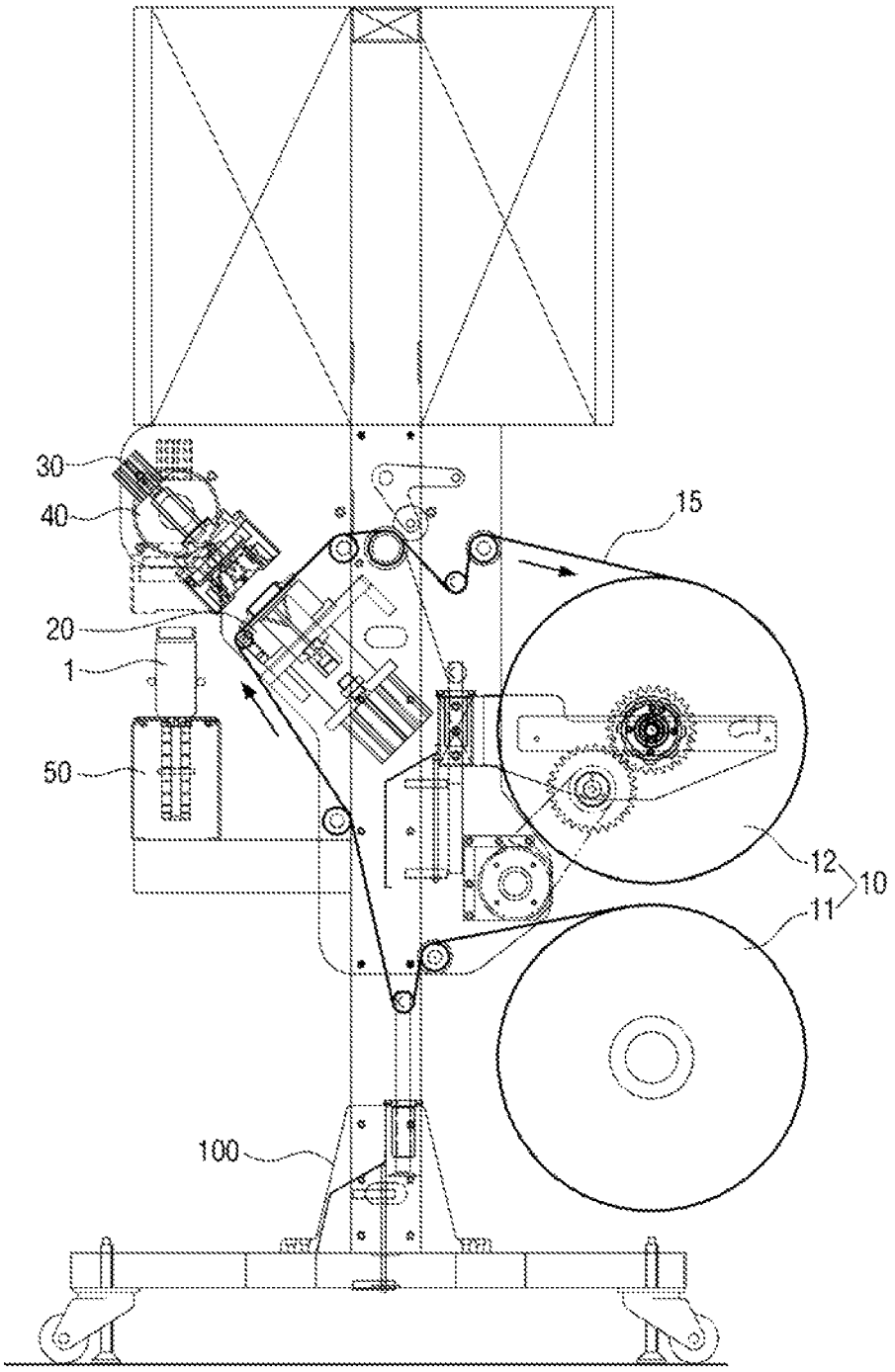
FIG. 3 is a front view of a capless sealing apparatus according to an embodiment of the present disclosure.
Figure 4:
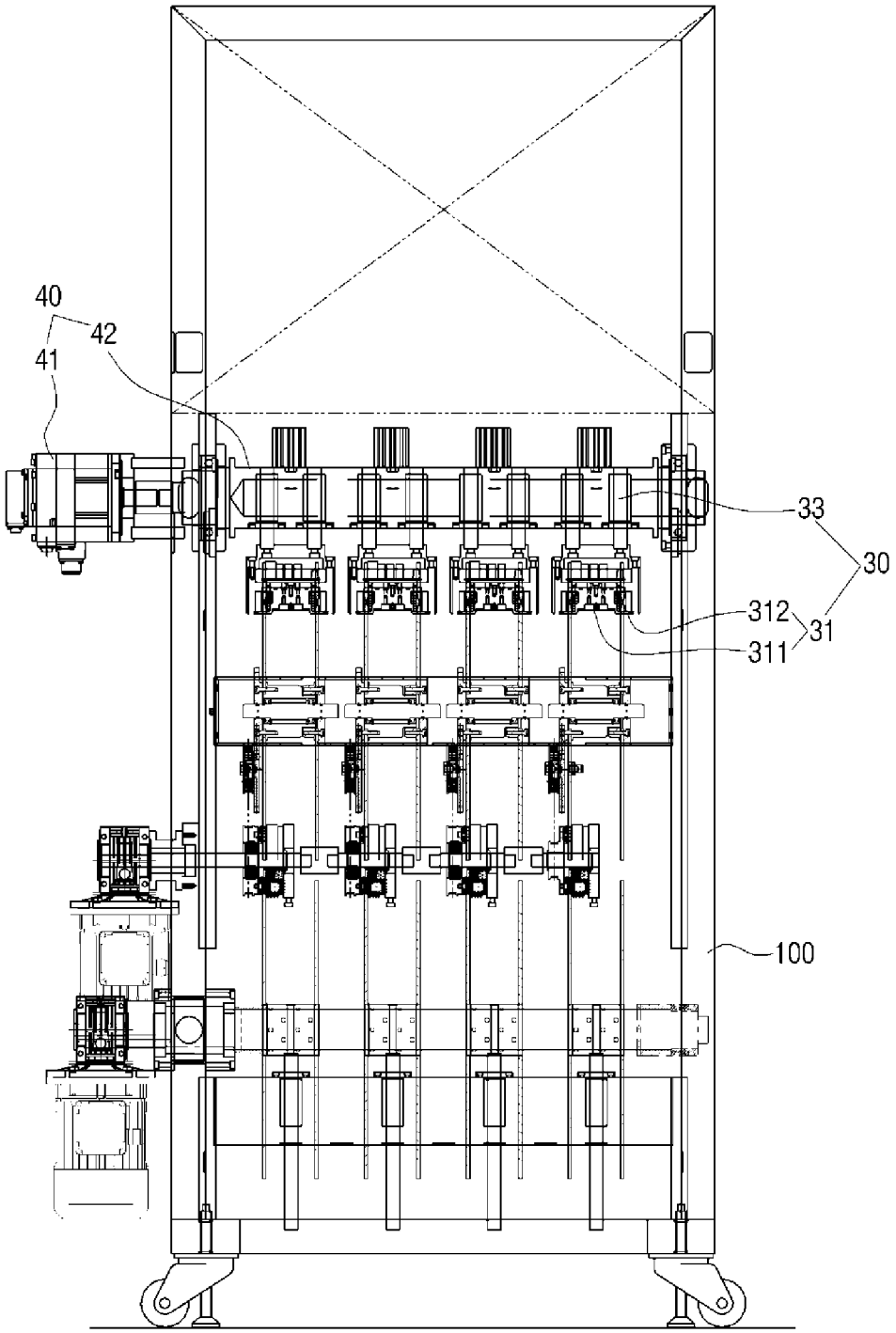
FIG. 4 is a side view of the capless sealing apparatus according to an embodiment.

FIG. 3 is a front view of a capless sealing apparatus according to an embodiment of the present disclosure, and FIG. 4 is a side view thereof. In each drawing, elements which are not essential in describing the present disclosure will not be described for convenience of explanation.

Referring to the drawings, the capless sealing apparatus for sealing a container according to an embodiment may include a tape transfer unit 10 installed in a main body 100 of the apparatus, a sealing foil cutting assembly 20, a container sealing unit 30 for sealing a container 1 with a sealing foil, and a container support stand 50 for supporting the container 1.

The tape transfer unit 10 may include a supply roll 11, a collection roll 12, and a driving unit for rotating the supply roll or the collection roll. A sealing tape 15 is wound around the supply roll 11 in the form of a roll. The sealing tape 15 is unwound from the supply roll 11 and is transferred along a predetermined path in the main body 100 of the apparatus, and then is wound around the collection roll 12 and is collected.

The sealing tape 15 is a raw material of the sealing foil 16 for sealing the container 1. In an embodiment, the sealing tape 15 may be formed in a layered structure, including a heat seal film, an aluminum foil, or a backing layer formed of a synthetic resin or paper, to be appropriate to induction sealing. However, the sealing tape 15 may have a layered structure made of various films (or layers) according to a specific embodiment, such as a purpose of the container 1.

The sealing foil cutting assembly 20 is disposed on a path through which the sealing tape 15 is transferred. The sealing foil cutting assembly 20 produces the sealing foil 16 by cutting a predetermined shape out of the sealing table 15. In an embodiment, the sealing foil cutting assembly 20 produces the sealing foil 16 including the lid 16*a* and the tab 16*b*, and the sealing foil 16 is produced with the tab 16*b* being folded upwardly and overlapping with the upper portion of the lid 16*a*, as shown in FIG. 2. An exemplary structure and an operation of the sealing foil cutting assembly 20 will be described below in detail with reference to FIGS. 5 to 13B.

The container sealing unit 30 is disposed on an upper portion of the sealing foil cutting assembly 20. As shown in FIG. 3, the container sealing unit 30 and the sealing foil cutting assembly 20 are disposed to face each other with the sealing tape 15 being placed therebetween. The sealing foil 16 produced at the sealing foil cutting assembly 20 is transferred to the container sealing unit 30.

The main body 100 of the apparatus may include a plurality of container sealing units 30. In an embodiment illustrated FIG. 4, four container sealing units 30 are installed in parallel. In this case, it will be understood that four sealing foil cutting assemblies are installed in parallel although not shown. That is, the capless sealing apparatus illustrated in the drawing may produce four sealing foils 16 at a time, and may seal four containers 1 at a time. The number of the sealing foil cutting assemblies 20 and the number of the container sealing units 30 may vary according to a specific embodiment.

In the embodiment illustrated in FIG. 4, the container sealing unit 30 includes a sealing head 31 and a driving unit 33 for moving up and down the sealing head 31. In an embodiment, the driving unit 33 may be an air cylinder. The sealing head 31 includes an adsorption portion 311 and an induction coil 312. The adsorption portion 311 is formed on a lower surface of the sealing head 31 to adsorb the sealing foil 16 produced at the sealing foil cutting assembly 30. The induction coil 312 forms an alternating current magnetic field of a high frequency according to an induction sealing method, thereby attaching the sealing foil 16 to the container 1 and sealing the container 1. Although elements for operations of the adsorption portion 311 and the induction coil 312, such as an air inlet, a vacuum pump, a high frequency current generator, or the like, are required, they have nothing to do with the description of the present disclosure and thus will not be described in detail.

The plurality of container sealing units 30 may be configured to be rotated within a predetermined angle by a rotating means 40. As shown in the drawing, the rotating means 40 includes a driving means 41 and a rotation shaft 42 connected to the driving means 41. The plurality of container sealing units 30 are attached to the rotation shaft 42 in parallel. The container sealing unit 30 attached to the rotation shaft 42 may be rotated within a predetermined rotation angle according to a rotation of the shaft 42. In the illustrated embodiment, the container sealing unit 30 may be rotated between a first position in which an adsorption surface of the adsorption portion 311 is inclined from the vertical by a predetermined angle (that is, a position illustrated in FIG. 3), and a second position in which the adsorption surface of the adsorption portion 311 faces downward in the vertical direction (a position illustrated by a dashed line in FIG. 3). In the illustrated embodiment, an angle between the first position and the second position may be 45 degrees. However, in an alternative embodiment, the angle between the first position and the second position may be a certain angle ranging from 30 degrees to 60 degrees.

The sealing foil cutting assembly 20 is disposed to face the adsorption surface of the adsorption portion 311 when the container sealing unit 30 is in the first position as shown in FIG. 3.

In addition, the container 1 is disposed to have its upper surface face the adsorption surface of the adsorption portion 311 when the container sealing unit 30 is in the second position as illustrated by the dashed line in FIG. 3. To achieve this, the container support stand 50 to support the container 1 may be disposed vertically below the container sealing unit 30.

An exemplary container sealing operation according to the above-described configuration will be described. First, the sealing foil cutting assembly 20 produces the sealing foil 16 by cutting the sealing tape 15 passing through the assembly 20. As shown in FIG. 2, the sealing foil 16 may be produced with the tab 16*b* being folded and overlapping with the upper portion of the lid 16*a* as shown in FIG. 2. In this case, the container sealing unit 30 is rotated by the rotating means 40 and is placed in the first position, and accordingly, the adsorption surface of the adsorption portion 311 faces an upper surface of the sealing foil 16. Thereafter, the sealing head 31 including the adsorption portion 311 is moved down toward the sealing foil 16 by driving of the cylinder 33, and then the adsorption portion 311 adsorbs the sealing foil 16.

When the sealing foil 16 is adsorbed, the sealing head 31 is moved up by driving of the cylinder 33, and the container sealing unit 30 is rotated to the second position with the sealing foil 16 being adsorbed thereonto, and is placed vertically above the container 1. After that, the sealing head 32 is moved down again and places the sealing foil 16 on an upper end of the container 1, and performs induction sealing by applying a high frequency current to the induction coil 312. The sealing foil 16 is adsorbed onto the upper entrance of the container 1 by induction sealing, and seals the container 1, and the sealed container 1 may be transferred for a next process (for example, a process of fastening a cap (lid) to the upper end of the container 1).

According to the embodiment of the present disclosure described above, the sealing apparatus is configured to include the sealing foil cutting assembly 20, the container sealing unit 30, and the container support stand 50, which are disposed adjacent to one another, and to rapidly transfer the sealing foil 16 produced at the sealing foil cutting assembly 20 to the container 1. That is, the container sealing unit 30 is configured to be rotated about the rotation shaft 42 by a predetermined angle between the first position and the second position and the sealing foil cutting assembly 20 and the container 1 are positioned in the first position and the second position, respectively. Accordingly, in the case of a related-art sealing apparatus, the sealing foil cutting assembly 20 should be moved along the X, Y, and Z axes vertically and horizontally many times to supply the sealing foil 16 to the container 1, but the container sealing unit 30 according to the present disclosure can supply the sealing foil 16 to the container 1 simply by being rotated by a short distance, and thus there are advantages that the apparatus has a simplified structure and also completes the container sealing operation within a short time.

Figure 5:
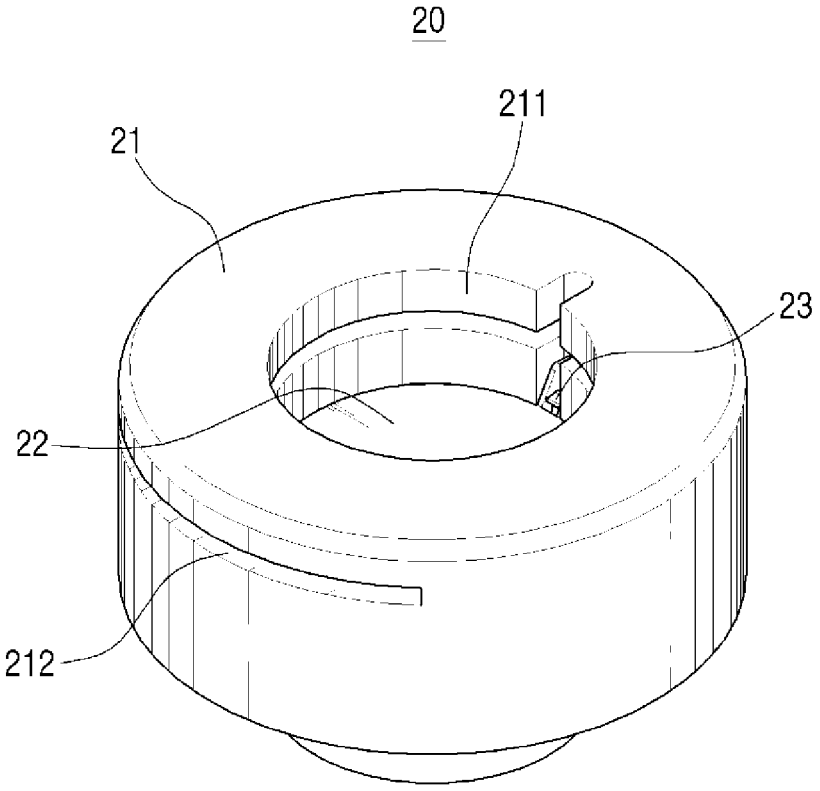
FIG. 5 is a perspective view of a sealing foil cutting assembly according to an embodiment.
Figure 6:
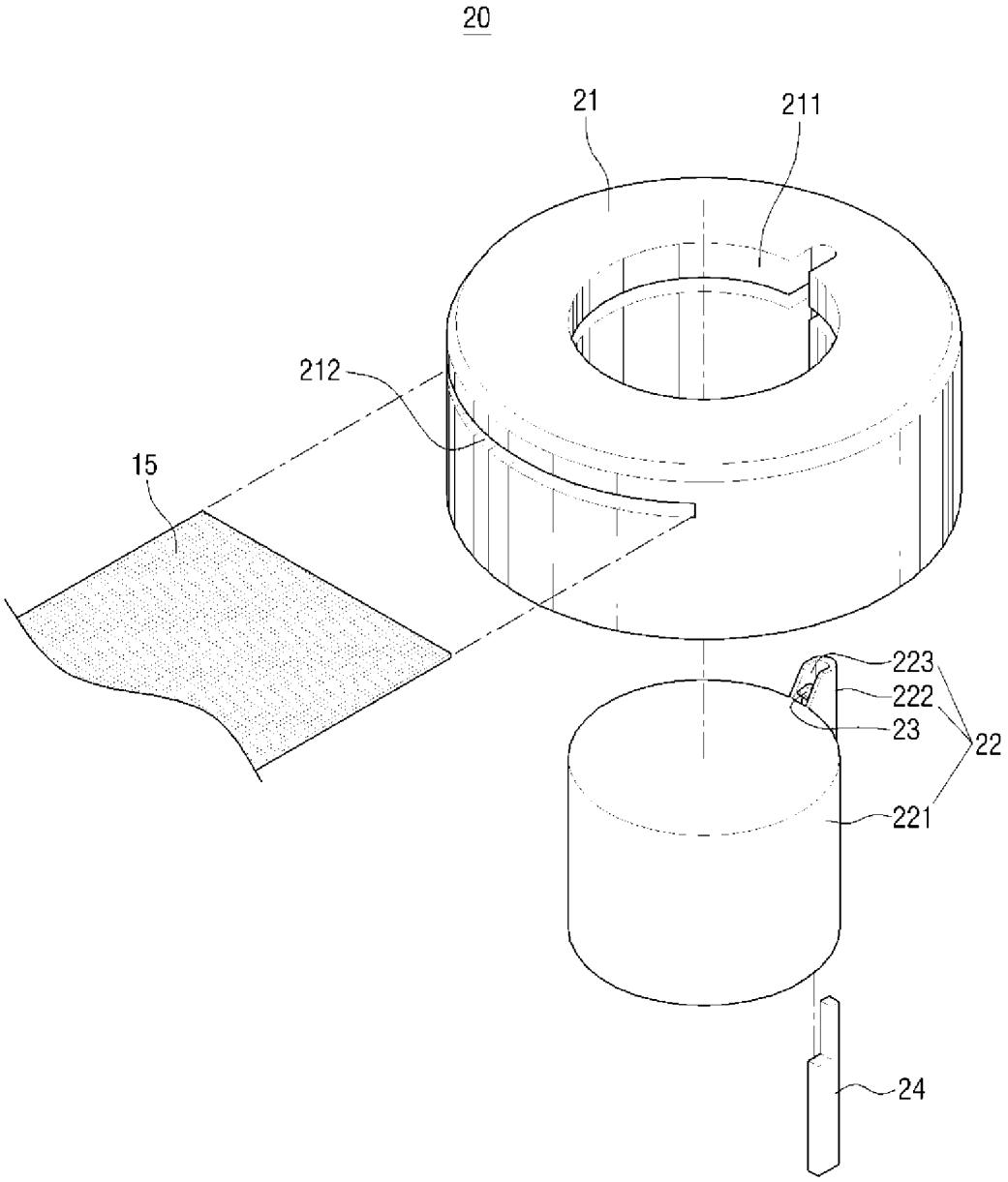
FIG. 6 is an exploded perspective view of the sealing foil cutting assembly according to an embodiment.
Figure 7:
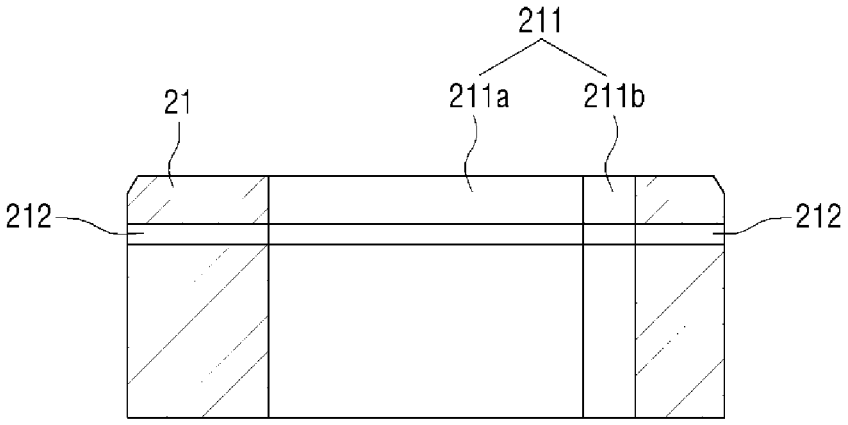
FIG. 7 is a cross-sectional view of a cutting die according to an embodiment.
Figure 8:
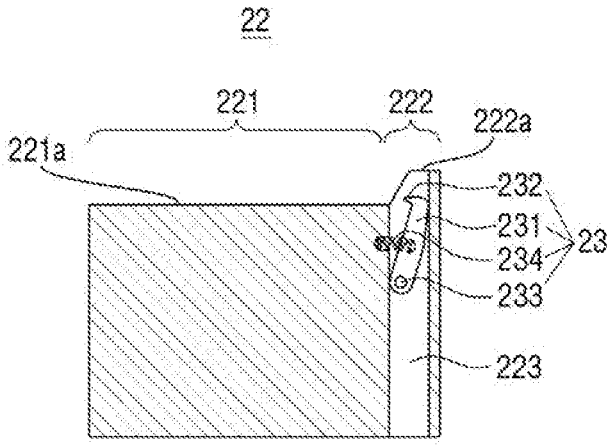
FIG. 8 is a cross-sectional view of a punch according to an embodiment.

Referring now to FIGS. 5 to 14B, the sealing foil cutting assembly 20 of the present disclosure will be described. FIG. 5 is a perspective view of the sealing foil cutting assembly 20 according to an embodiment, FIG. 6 is an exploded perspective view of the sealing foil cutting assembly 20, and FIGS. 7 and 8 are cross-sectional views of a cutting die 21 and a punch 22 according to an embodiment, respectively.

Referring to the drawings, the sealing foil cutting assembly 20 according to an embodiment includes a cutting die 21, a punch 22 moving through the inside of the cutting die 21, a finger member 23 attached to the punch 22, and a finger member driving rod 24. Referring to FIGS. 5 to 7, the cutting die 21 is a substantially cylindrical member. However, in an alternative embodiment, the cutting die 21 may have other three-dimensional figures.

The cutting die 21 may include a slot 212 through which the sealing tape 15 passes, and a penetrating hole 211 formed in a direction perpendicular to the slot 212. The slot 212 is formed to penetrate through a side surface of the cutting die 21 to allow the sealing tape 15 to pass from one side surface of the cutting die 21 to the other surface. A with and a height of the slot 212 may be determined by considering a width and a thickness of the sealing tape 15. The penetrating hole 211 is formed to penetrate through an upper surface and a lower surface of the cutting die 21. The punch 22 slides up and down through the penetrating hole 211. Accordingly, the shape of the penetrating hole 211 may be determined according to a shape of a plane of the punch 22 which will be described below.

The punch 22 is a member that moves up through the inside of the penetrating hole 211 of the cutting die 21 to cut the sealing tape 15. That is, when the sealing tape 15 penetrates through the cutting die 21 through the slot 212, the punch 22 cuts the sealing tape 15 while moving up and, and accordingly, a piece of the sealing tape that has the same shape as the shape of the plane of the punch 22 is cut out of the sealing tape 15 and separated therefrom, and the cut piece is the sealing foil 16.

Referring to FIGS. 5, 6, and 8, the punch 22 according to an embodiment may include a lid cutting portion 221 which is formed in a substantially cylindrical shape, and a tab cutting portion 222 protruding from a side surface of the lid cutting portion 221. The lid cutting portion 221 has a circular shape as viewed from above, and accordingly, when the lid cutting portion 221 cuts the sealing tape 15, the lid 16*a* region of the sealing foil 16 is produced. The tab cutting portion 222 protrudes from the side surface of the lid cutting portion 221. Therefore, when the tab cutting portion 222 cuts the sealing tape 15, the tab 16*b* region of the sealing foil 16 is produced. That is, it will be understood that the shape of the sealing foil 16 is determined according to the shape of the plane of the punch 22.

Accordingly, the shape of the punch 22 may vary according to a shape of the sealing foil 16 to be produced. For example, in order to produce a sealing foil having a plurality of tab 16*b* regions formed around the lid 16*a* region, a punch having a plurality of tab cutting portions 222 formed around the lid cutting portion 221 may be used.

As shown in the drawing, there is a stepped portion between an upper surface of the lid cutting portion 221 and an upper surface of the tab cutting portion 222. That is, the surface 222*a* of the tab cutting portion 222 is configured to be higher than the surface 221*a* of the lid cutting portion 221. Accordingly, when the punch 22 is moved up in the penetrating hole 211 of the cutting die 21, and cuts the sealing tape 15, the tab cutting portion 222 comes into contact with the sealing tape 15 before the lid cutting portion 221. Therefore, the tab 16*a* region of the sealing foil 16 is cut first, and thereafter, the lid 16*a* region is cut, such that the sealing foil 16 is formed.

In the illustrated embodiment, the tab cutting portion 222 has an empty space, that is, a hollow 223, formed therein. In an embodiment, the hollow 223 penetrates from an upper surface of the tab cutting portion 222 to a lower surface. The punch 22 may include a finger member 23 disposed in the hollow 223 of the tab cutting portion 222. As shown in FIG. 8, the finger member 23 may include a finger main body 231 and a bent portion 232 formed at an upper end of the finger main body 231. The bent portion 232 is bent toward the surface of the lid cutting portion 221.

The finger member 23 may be coupled to the tab cutting portion 222 by means of a hinge. A protrusion 233 protrudes from the lower portion of the finger main body 231 to the outside, and is inserted into a recess or a penetrating hole (not shown) formed on an inner surface of the hollow 223 of the tab cutting portion 22, such that the finger member 23 is coupled by means of a hinge.

In the embodiment illustrated in FIG. 8, one or more elastic portions 234 are interposed between the punch 22 and the finger member 23. The elastic portion 234 may be a spring, for example, but may be implemented by other elastic members.

The finger member 23 may be rotated about a rotation axis of the protrusion 233 within a predetermined range, and accordingly, the upper bent portion 232 of the finger member 23 may cover or may not cover a portion of the surface of the lid cutting portion 221. That is, when no external force is applied to the finger member 23, the finger member 23 may be in a position (hereinafter, a "first position") in which the finger member 23 does not cover a portion of the surface 221*a* of the lid cutting portion 221 as shown in FIG. 8.

When an external force is applied to the finger member 23, for example, when the rod 24 is inserted into the hollow 223 from below and pushes the finger main body 231 of the finger member 23, the finger member 23 is rotated in the counter clockwise direction and reaches a position (hereinafter, a "second position") in which the bent portion 232 covers a portion of the surface 221*a* of the lid cutting portion 221. Thereafter, when the rod 23 is removed, the finger member 23 is rotated by an elastic force of the elastic portion 234 in the clockwise direction, and returns to the first position as shown in FIG. 8. That is, when no force is applied to the finger member 23, the bent portion 232 is maintained in the first position by the elastic force of the elastic portion 234, and, when a force is applied to the finger member 23, the bent portion 232 is moved to the second position.

FIGS. 9A to 12 illustrate an operation of the sealing foil cutting assembly 20 according to the above-described exemplary configuration.

Figure 9A:
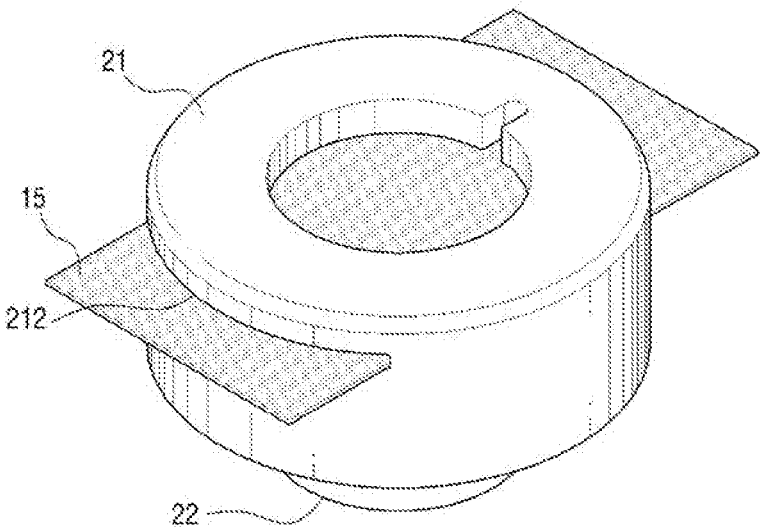
FIGS. 9A, 9B, 10, 11A, 11B and 12 are views to illustrate an operation of the sealing foil cutting assembly according to an embodiment.
Figure 9B:
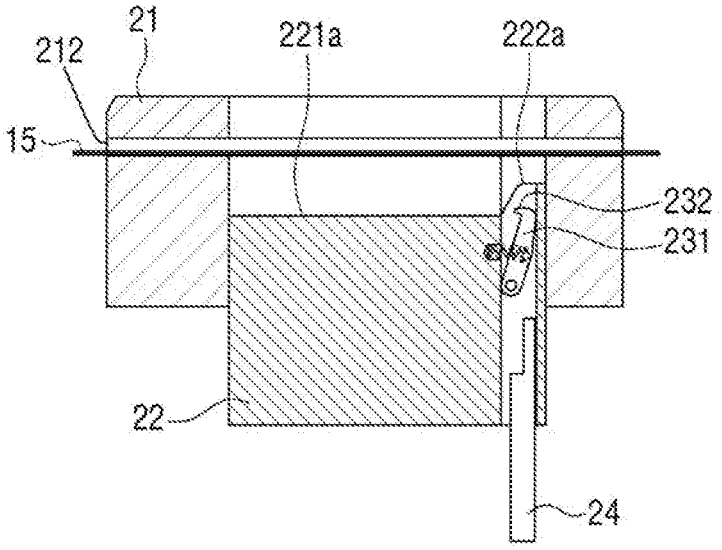

FIGS. 9A and 9B illustrate the sealing tape 15 which passes through the cutting die 21 through the slot 212 of the cutting die 21, and is transferred. As shown in FIG. 9B, the punch 22 is positioned in a lower side of the inside of the penetrating hole 211 of the cutting die 21. That is, the surface 221*a* of the lid cutting portion 221 of the punch 22 and the surface 222*a* of the tab cutting portion 222 are positioned below the sealing tape 15. In addition, since no force is applied to the finger member 23 at this time, the upper bent portion 232 of the finger member 23 is placed in the first position, that is, does not cover the surface 221*a* of the lid cutting portion 221.

Figure 10:
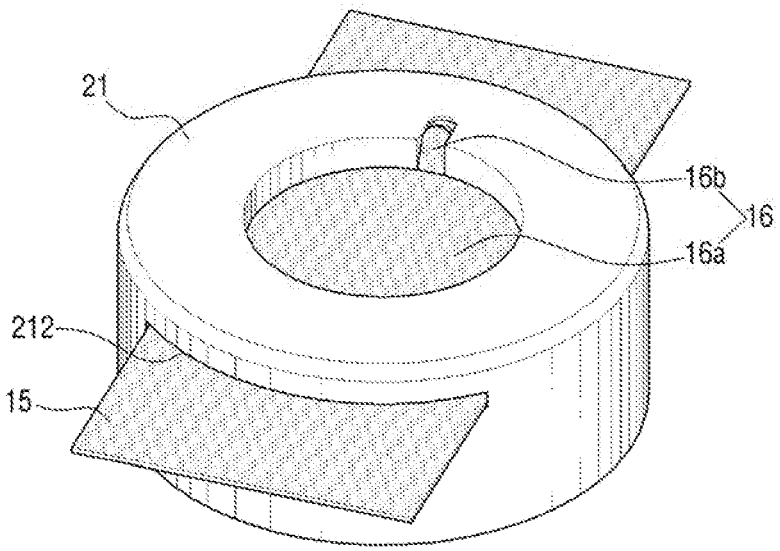

Thereafter, the transfer of the sealing tape 15 is temporarily stopped, and the punch 22 is moved up and thereby cuts the sealing tape 15. Since the surface 222*a* of the tab cutting portion 222 is higher than the surface 221*a* of the lid cutting portion 221 as described above, the punch 22 is moved up and cuts the tab 16*b* region of the sealing foil 16, first, as shown in FIG. 10. In addition, since there is a stepped portion between the two surfaces 221*a*, 222*a*, the tab 16*b* region cut first may be slightly bent upward.

Figure 11A:
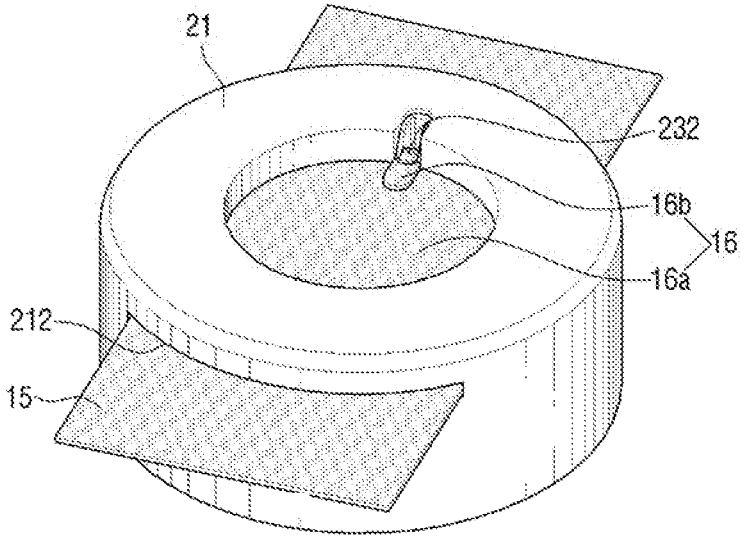
Figure 11B:
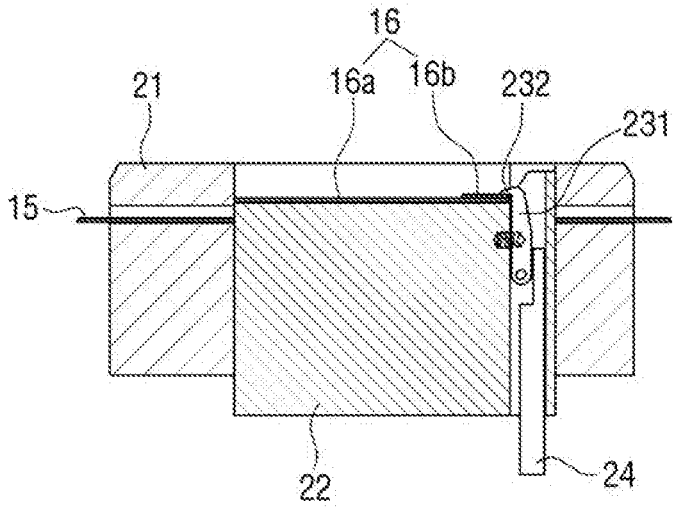

When the punch 22 is further moved up, the lid 16*a* region is cut out of the sealing tape 15, and accordingly, the sealing foil 16 including the lid 16*a* and the tab 16*b* is formed. The sealing foil 16 is cut and separated from the sealing tape 15, and is moved up along with the punch 22. In this case, the finger driving rod 24 pushes up the finger main body 231 of the finger member 23. Accordingly, the finger main body 231 is rotated in the counter clockwise direction, and the bent portion 232 at the upper end of the finger main body 231 is also rotated, thereby bending the tab 16*b* region of the sealing foil 16. That is, as shown in FIGS. 11A and 11B, the tab 16*b* region of the sealing foil 16 is folded over and overlaps with the lid 16*a* region.

Figure 12:
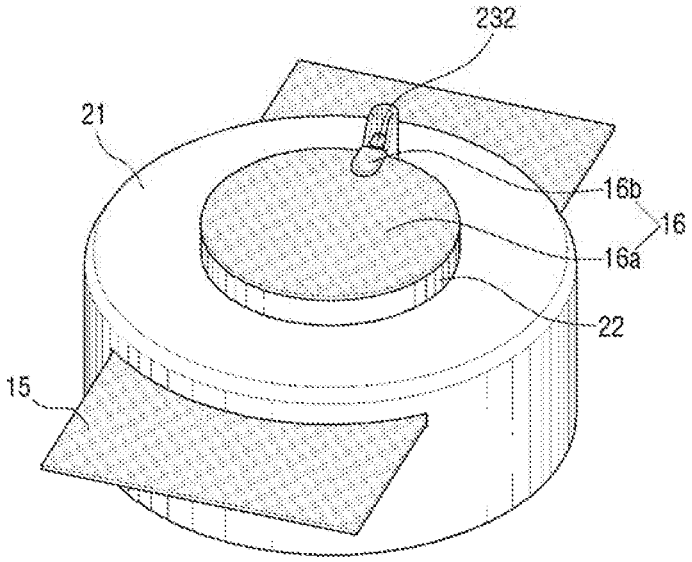

After that, the punch 22 is further moved up until the surface of the punch 22 protrudes from the upper portion of the cutting die 21 as shown in FIG. 12, and, as described above with reference to FIGS. 3 and 4, the sealing head 31 of the container sealing unit 30 approaches the surface of the punch 22 and adsorbs the sealing foil 16, and transfers the sealing foil 16 to the container 1.

Referring now to FIGS. 13A and 13B and FIGS. 14A and 14B, a punch 22 according to various alternative embodiments will be described.

Figure 13A:
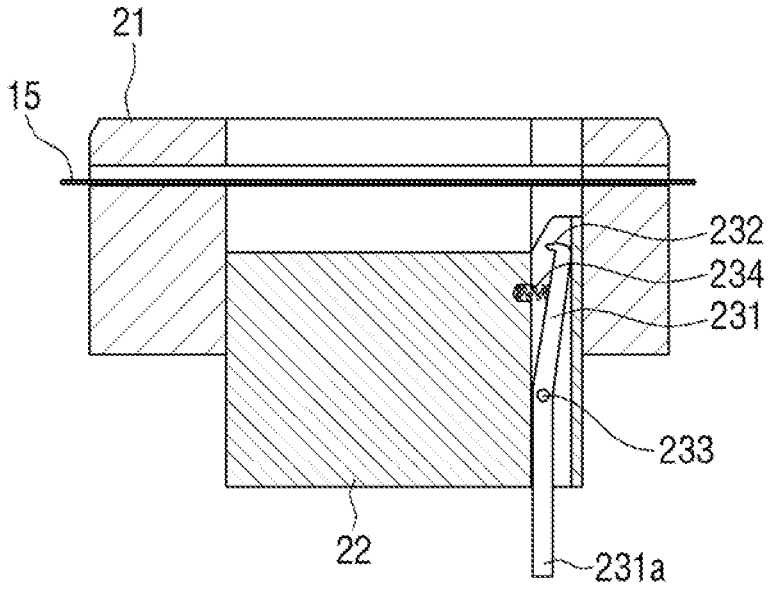
FIGS. 13A and 13B and FIGS. 14A and 14B are views to illustrate a punch according to various alternative embodiments.

The finger member according to an embodiment of FIG. 13A is similar to the finger member 23 of FIG. 8 in that the finger member includes the main body 231 and the bent portion 232 formed at the upper portion of the main body 231, and is hinged to the punch 22 by means of the protrusion 233. However, referring to FIG. 13A, the main body 231 of the finger member further extends downward from the protrusion 233. A lower end 231*a* of the main body 231 protrudes from the lower surface of the punch 22 and further extends downward, and the bent portion 232 of the main body 231 is moved between the first position and the second position by moving the lower end 231*a* horizontally.

Figure 13B:
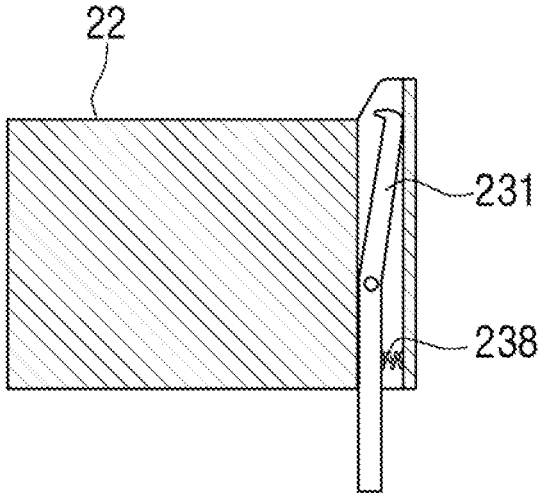

FIG. 13B illustrates a finger member according to still another alternative embodiment. In this embodiment, an elastic portion 238 is interposed between the main body 231 of the finger member and the punch 22. The elastic portion 234 in the embodiment of FIG. 13A is disposed on an upper portion of the protrusion 233 serving as a rotation axis of the hinge, whereas the elastic portion 238 in the embodiment of FIG. 13B is disposed on a lower portion of the protrusion 233.

Figure 14A:
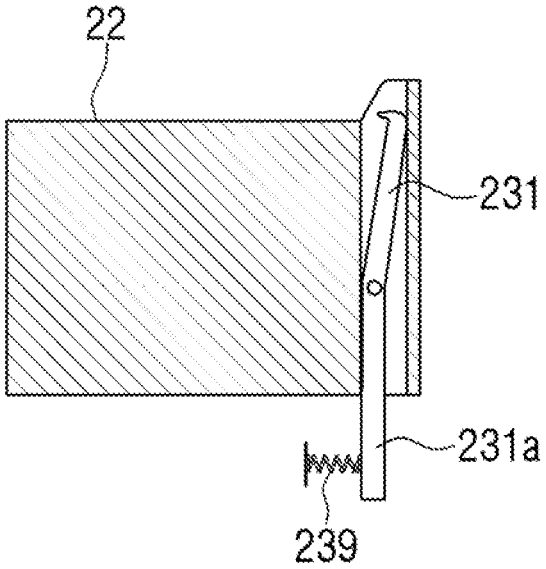

FIG. 14A illustrates a finger member according to yet another alternative embodiment. In this embodiment, an elastic portion 239 may be implemented as a spring connected with a lower end 231*a* of the finger member. One end of the spring may be connected to the lower end 231*a* of the finger member, and the other end may be connected to a certain portion of the punch 22.

As described, when no force is applied to the finger member 23, the bent portion 232 of the finger member may be maintained in the first position by the elastic force of the elastic portion 234, 238, 239, and the installation position, shape, material, or etc. of the elastic portion 234, 238, 239 performing the above-described function is not fixed to any one, and may vary according to a specific embodiment of the present disclosure.

Figure 14B:
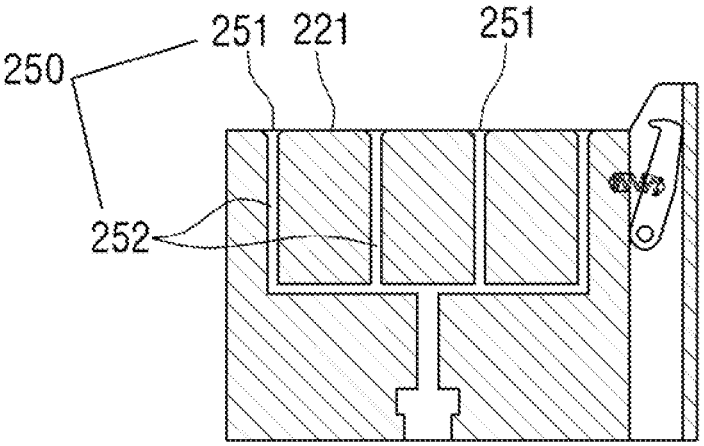

FIG. 14B illustrates a cross section of a punch 22 according to further alternative embodiment. In this embodiment, the lid cutting portion 221 of the punch 22 may include an adsorption portion 25. The adsorption portion 25 may include an adsorption hole 251 formed on a surface of the lid cutting portion 221, and a discharge pipe 252 formed in the lid cutting portion 221 to allow the air to pass therethrough. The discharge pipe 252 may be connected to a vacuum pump (not shown).

According to this embodiment, the sealing foil 16 is attached to the upper surface of the punch 22 without being detached therefrom by the operation of the adsorption portion 25. Accordingly, even when the sealing foil cutting assembly 20 is inclined as shown in FIG. 3 and the surface of the punch 22 is also inclined, the sealing foil 16 may not slid on the surface of the punch 22.

Figure 15:
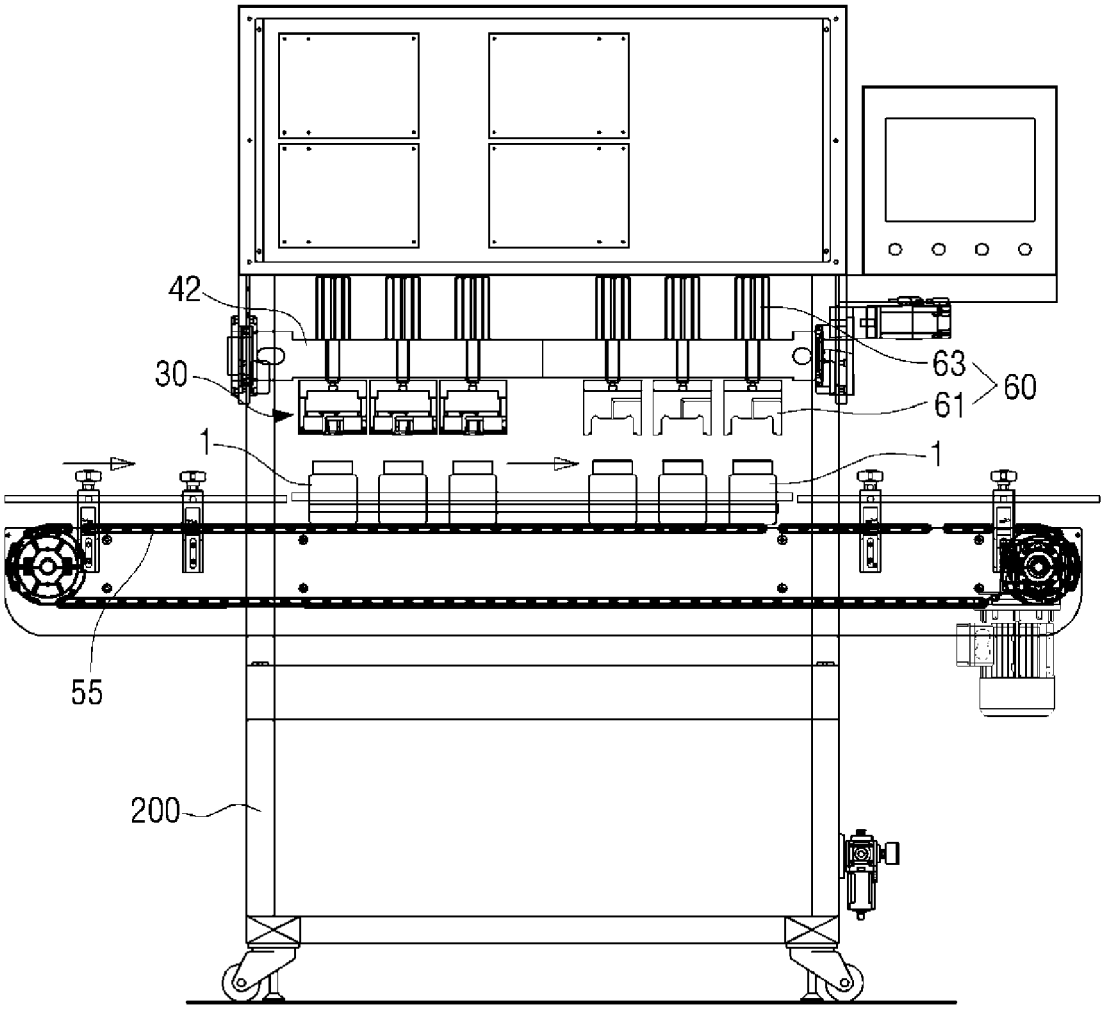
FIG. 15 is a side view of a capless sealing apparatus according to another embodiment of the present disclosure.
Figure 17A:
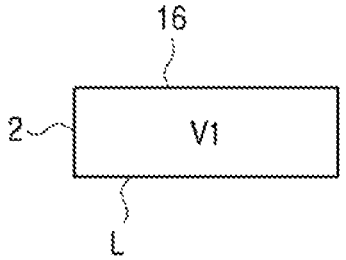
FIG. 17A is a view to illustrate a volume V1 of the air in a container.
Figure 17B:
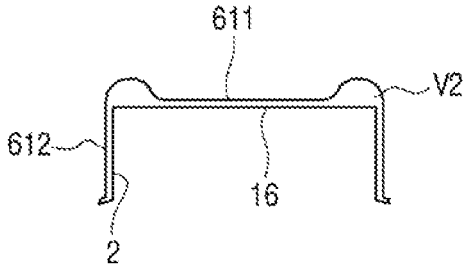
FIG. 17B is a view to illustrate a volume V2 of a vacuum chamber.

Referring now to FIGS. 15 and 17B, an operation of examining whether the sealed container is securely sealed will be described.

FIG. 15 is a side view of a capless sealing apparatus according to another embodiment of the present disclosure. The side view of FIG. 15 is similar to the side view of the capless sealing apparatus of FIG. 4. However, a main body 200 of the capless sealing apparatus of FIG. 15 may further include a sealing examination unit 60 and a conveyor belt 55 for moving the container.

Referring to the drawings, the rotation shaft 42 connected to a driving means (not shown) is installed in the main body 200, and three container sealing units 30 and three sealing examination units 60 are attached to the rotation shaft 42 in parallel. When three containers 1 are transferred by the conveyor belt 55, and are placed under the three container sealing units 30, the container sealing units 30 seal the respective containers 1. Thereafter, the conveyor belt 55 transfers the three sealed containers to the sealing examination units 60. When the three sealed containers 1 are placed under the three sealing examination units 60, the sealing examination units 60 may examine whether the respective containers are securely sealed.

Although the three container sealing units 30 and the three sealing examination units 60 are illustrated in the illustrated embodiment, the numbers of these elements may vary according to a specific embodiment of the present disclosure.

Figure 16A:
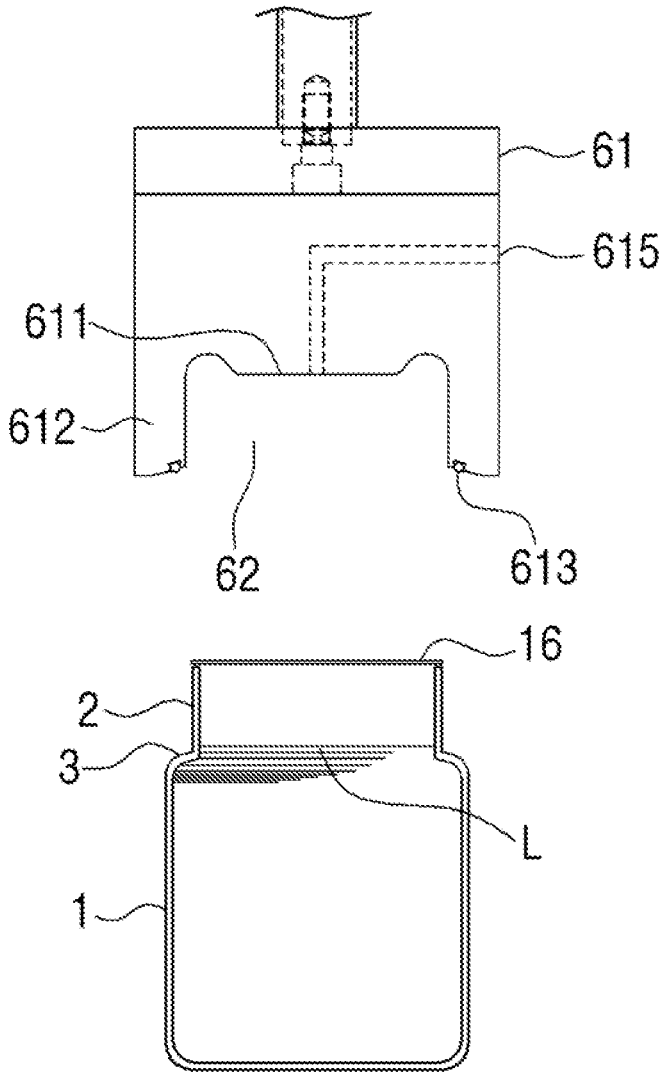
FIGS. 16A and 16B are views to illustrate a vacuum chamber main body according to an embodiment.
Figure 16B:
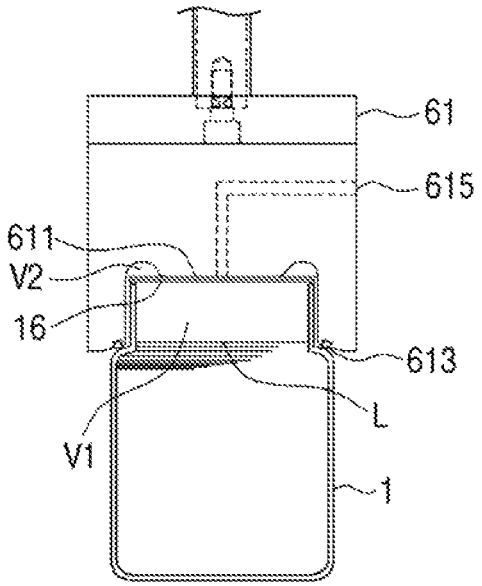

Each of the sealing examination units 60 may include a vacuum chamber main body 61 and a driving cylinder 63 for moving up and down the vacuum chamber main body 61. FIGS. 16A and 16B illustrate the vacuum chamber main body 61 according to an embodiment. Referring to FIG. 16A, the vacuum chamber main body 61 is a member having a chamber space 62 formed in a lower portion thereof. To make the chamber space 62, the vacuum chamber main body 61 may include a side surface extension portion 612 surrounding the chamber space. An O-ring 613 is installed on a lower end of the side surface extension portion 612 to seal.

In an embodiment, the side surface extension portion 612 has a width and a depth enough to cover the entrance 2 of the container 1. That is, when the container 1 has a normal shape, that is, a diameter of the entrance 2 of the container 1 is smaller than a diameter of the container 1, and the container 1 and the entrance 2 of the container are connected to each other by a shoulder 3, as in the illustrated embodiment, the width and the height of the side surface extension portion 612 may be set such that the side surface extension portion 612 is brought into close contact with the shoulder 3 of the container.

The vacuum chamber main body 61 includes one or more suction pipes 615 to suck the air into the chamber space 62. In the illustrated embodiment, one end of the suction pipe 615 may be connected to a bottom surface 611 of the vacuum chamber main body 61, and the other end may be connected to a vacuum pump (not shown).

A center region of the bottom surface 611 of the vacuum chamber main body 61 may slightly protrude downward. This is to prevent the sealing foil 16 from being detached from the container 1 in a vacuum state, and to prevent contents from flowing out from the container.

When the vacuum chamber main body 61 is moved down by an operation of the driving cylinder 63, the chamber space 62 may cover the entrance 2 of the container as shown in FIG. 16B. In this case, the chamber space 62 has a sealed space V2 as shown in FIG. 17B. That is, the sealed space V2 is a space that is surrounded by the bottom surface 611 of the main body, an inner surface of the side surface extension portion 612, an outer circumference of the entrance 2 of the container, and the sealing foil 16 attached to the upper portion of the container.

An exemplary examination operation of the sealing examination unit 60 according to the above-described configuration will be described below.

First, when the container 1 to be examined is placed under the vacuum chamber main body 61 as shown in FIG. 16A, the vacuum chamber main body 61 is moved down and the chamber space 62 of the vacuum chamber main body 61 covers the entrance 2 of the container from above as shown in FIG. 16B. Accordingly, the sealed space V2 is formed between the vacuum chamber main body 61 and the container 1 as shown in FIG. 17B.

When the sealed space V2 is formed, the sealing examination unit 60 operates the vacuum pump (not shown), and sucks the air of the sealed space V2 into the suction pipe 615 and makes the sealed space V2 in a vacuum state. In this case, when the sealing state of the container is normal and the air of the sealed space V2 is sucked for a predetermined time, the sealed space V2 reaches a predetermined degree of vacuum. However, when the sealing state of the container is poor, the predetermined degree of vacuum may not be reached until the air filled in an inner space V1 of the container is completely sucked. Therefore, a degree of vacuum when the air of the sealed space V2 is sucked for the predetermined time does not reach the predetermined degree of vacuum, or time required to reach the predetermined degree of vacuum is longer than when the sealing state is normal. Accordingly, in an embodiment, it may be determined whether the sealing state of the container is normal or poor by measuring the degree of vacuum of the sealed space V2 after the air is sucked for the predetermined time, or by measuring time required to suck the air until the predetermined degree of vacuum is reached.

In an embodiment, when the air of the sealed space V2 is sucked, the sealed space V2 may reach a degree of vacuum of 30 to 50 Kpa within 0.1 to 0.5 second, and, when the vacuum state is maintained for 0.5 to 2 seconds thereafter, it may be determined that the sealing state of the container is normal. However, the predetermined time or the predetermined degree of vacuum may vary according to sizes of the inner space V1 of the container and the sealed space V2. As shown in FIG. 17A, the inner space V1 of the container is a space that is filled with the air in the container 1, and is surrounded by a surface L of a content, the sealing foil 16, and the inner circumference of the container entrance 2. On the other hand, the sealed space V2 is a space that is formed between the vacuum chamber main body 61 and the container 1 as shown in FIG. 17B.

Accordingly, in order to make the sealed space V2 reach the predetermined degree of vacuum within a short time, and to determine whether the sealing state is normal, a smaller volume of the sealed space V2 in comparison to the inner space V1 of the container 1 may be more effective. In an embodiment, the volume of the sealed space V2 may be 50% or less of the volume of the inner space V1 of the container.

When the container to be examined does not include the shoulder 3, the vacuum chamber main body 61 illustrated in FIGS. 16A and 16B cannot be applied. In this case, a vacuum chamber main body having a side surface extension portion 612 further extending may be used. That is, the side surface extension portion 612 may be configured to reach the support stand 50 supporting the container 1 or a bottom surface of the conveyor belt 55 when the chamber space 62 of the vacuum chamber main body 61 covers the container 1, and thus a sealed space may be formed around the container 1.

While the invention has been shown and described with reference to certain preferred embodiments thereof, it will be understood by those skilled in the art that various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

What is claimed is:

1. A high-frequency capless sealing apparatus for sealing a container, the apparatus comprising:

a sealing tape transfer unit comprising a supply roll having a sealing tape wound therearound, and a collection roll to collect the sealing tape;

a sealing foil cutting assembly disposed on a transfer path of the sealing tape between the supply roll and the collection roll, the sealing foil cutting assembly comprising: a cutting die comprising a slot through which the sealing tape penetrates, and a penetrating hole formed in a direction perpendicular to the slot; and a punch configured to move up along the penetrating hole of the cutting die to cut the sealing tape to form a sealing foil to be used for sealing an entrance of a container;

a container support stand disposed adjacent to the sealing foil cutting assembly, and configured to support the container to be sealed; and a container sealing unit comprising a sealing head provided with an adsorption portion for adsorbing the sealing foil, and an induction coil, the adsorption portion adsorbing the sealing foil placed on a surface of the punch and transferring the sealing foil to an upper portion of the entrance of the container supported on the container support stand, the sealing foil being adsorbed onto the entrance of the container by applying a high-frequency current to the induction coil, wherein the punch comprises:

a lid cutting portion configured to form a lid region of the sealing foil;

a tab cutting portion having an empty space formed therein to form a tab region protruding from a side surface of the lid of the sealing foil; and a finger member disposed in the empty space of the tab cutting portion, and having an upper end bent toward a surface of the lid cutting portion, wherein a stepped portion is formed between the lid cutting portion and the tab cutting portion, such that a surface of the tab cutting portion is higher than the surface of the lid cutting portion, wherein the punch cuts the tab region of the sealing foil, first, and then, cuts the lid region when cutting the sealing tape, such that the tab region cut first is bent upwardly, and thereafter, the bent upper end of the finger member bends the cut tab region and makes the tab region overlap with the lid region.

2. The high-frequency capless sealing apparatus of claim 1, wherein the bent upper end of the finger member is configured to be moved between a first position in which the bent upper end does not cover the surface of the lid cutting portion, and a second position in which the bent upper end covers the surface of the lid cutting portion.

3. The high-frequency capless sealing apparatus of claim 2, wherein the finger member is coupled in the empty space of the tab cutting portion by means of a hinge, and wherein, when no force is applied to the finger member, the bent upper end is maintained in the first position, and, when a force is applied to the finger member, the bent upper end is moved to the second position.

4. The high-frequency capless sealing apparatus of claim 1, wherein the container sealing unit further comprises a driving unit configured to move up and down the sealing head in a reciprocating way, and wherein the container sealing unit is configured to be rotated between a first position in which an adsorption surface of the adsorption portion is inclined from the vertical by a predetermined angle, and a second position in which the adsorption surface faces downward in a vertical direction.

5. The high-frequency capless sealing apparatus of claim 4, wherein the sealing foil cutting assembly and the container sealing unit are disposed such that the adsorption surface and the surface of the punch face each other when the container sealing unit is in the first position, and wherein the container support stand is disposed to have the container placed vertically below the container sealing unit.

* * * * *